United States Patent [19]

McCabe

[11] Patent Number: 5,029,365

[45] Date of Patent: Jul. 9, 1991

[54] HEAD RAIL ATTACHMENT

[76] Inventor: William E. McCabe, 302 Dennis, Houston, Tex. 77006

[21] Appl. No.: 503,373

[22] Filed: Apr. 2, 1990

[51] Int. Cl.[5] ..... A47H 13/00; E06B 9/38

[52] U.S. Cl. ..... 16/87.4 R; 160/178.1; 160/900

[58] Field of Search ..... 16/87.4 R, 87.2; 160/38, 178.1, 900

[56] References Cited

U.S. PATENT DOCUMENTS 4,779,661 10/1988 Yalowega ..... 160/178.1

*Primary Examiner*—Richard K. Seidel
*Assistant Examiner*—Carmine Cuda

[57] ABSTRACT

A novel and aesthetically pleasing head rail attachment which may be used in combination with vertical blind head rail assemblies to help reduce the amount of sunlight entering through the open sides of vertical blinds when they are mounted away from a wall and on the outside of a window frame. The head rail attachment affixes easily to the existing vertical blind head rail and gives a completed or framed look to the existing window.

7 Claims, 2 Drawing Sheets

HEAD RAIL ATTACHMENT

FIELD OF THE INVENTION

The field of the present invention is window coverings and attachments. Specifically, an attachment to a vertical blind head rail assembly which enhances the window treatment while preventing streaks of sunlight from entering through the vertical slats.

BACKGROUND OF THE INVENTION

Blinds have been known and used for many years. Venetian blinds were popular for a number of years; then vertical blinds emerged. Horizontal blinds; more specifically, horizontal mini-blinds have been very popular for the last several years and are available in an array of colors and sizes. However, many residential and commercial decorators and their clients still prefer vertical blinds for a variety of reasons. The majority of horizontal blinds are mounted on the inside of a given window frame whereas vertical blinds are mainly mounted on the outside of a given window frame. Because of window configurations, alarm systems and the like, it is not always possible to mount blinds on the inside of the window. The primary complaint, however, regarding vertical blinds, or blinds mounted on the outside of window frames, is streaks of sunlight through the space created between the wall and the blinds. These streaks of sunlight are not only annoying, but may cause furniture and carpet to fade prematurely and unevenly.

While many improvements have been made on the head rail assembly for venetian and other blinds, nothing was found that specifically attended to the problem of sunlight streaking.

SUMMARY OF THE PRESENT INVENTION

The present invention is a novel and useful head rail attachment which enhances a window or patio door outfitted with blinds; specifically, vertical blinds, as well prevents annoying sunlight from entering through openings created between the wall and the blinds when they are mounted on the outside of the window frame. The head rail attachment consists of a hollow rectangular-shaped housing which attaches perpendicular to an existing head rail assembly. The housing may be mounted to the head rail and then adjusted to a proper fit by the use of appropriate hardware. Two vertical carriers are mechanically affixed to the housing which enables the insertion of two vertical slats which form a 90 degree angle or frame. Upon completion of both sides of a given window or patio door, the head rail attachment enhances the treated area for a finished look and most importantly greatly reduces or prevents the sun from entering. A valance may be placed over the head rail attachment and vertical head rail assembly for a final touch.

Manufacturing of the head rail attachment is relatively inexpensive and may be offered in two sizes which should accommodate virtually all window and patio door sizes.

An object of the present invention is to provide a useful attachment to a vertical head rail assembly which helps reduce amount of sunlight entering through openings created when blinds are mounted on the outside of a window frame.

Another object of the present invention is to provide an aesthetically pleasing compliment to existing window treatments.

Still another object of the present invention is to provide an attachment to an existing head rail assembly which may be attached easily and inexpensively.

Yet another object of the present invention is to provide an attachment which may be made in as few as two sizes which will accommodate virtually any size vertical blind treatment.

DESCRIPTION OF THE PREFERRED EMBODIMENT

Figure 1:
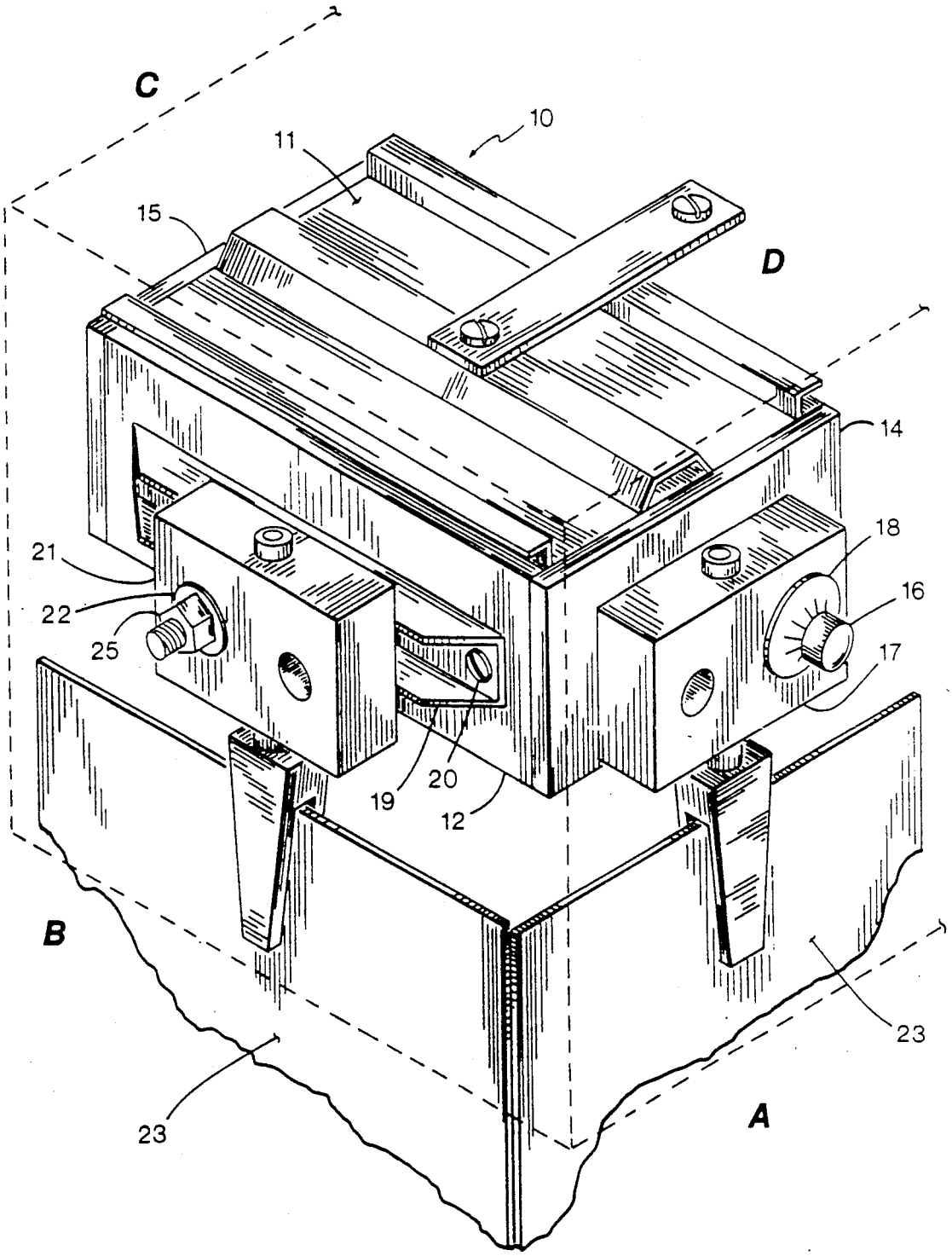
FIG. 1 illustrates the present invention with attached vertical slats.
Figure 2:
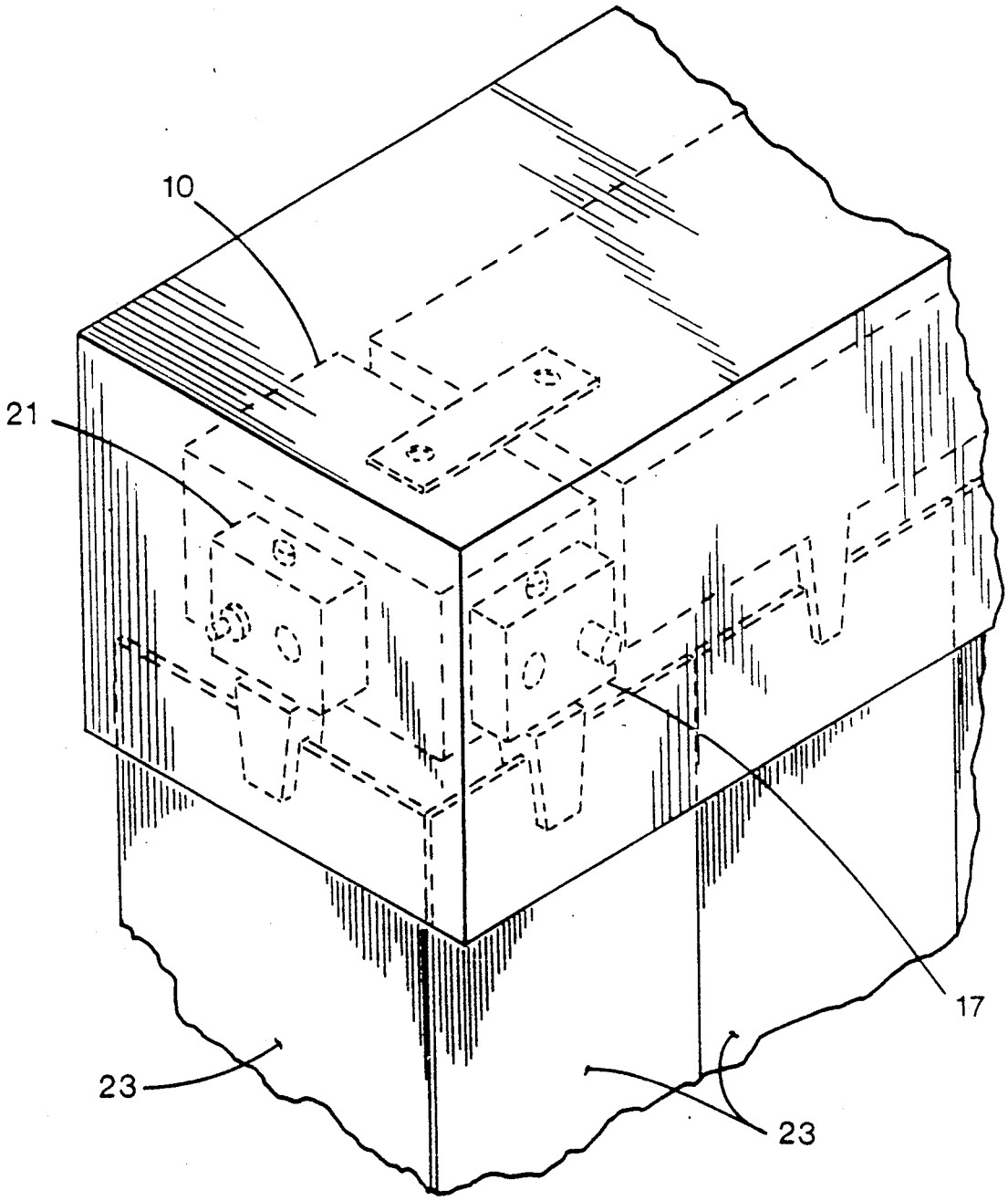
FIG. 2 illustrates the present invention in combination with a window complete with vertical blinds.

Referring now to FIG. 1 in more detail. The head rail attachment consisting of a hollow, rectangular-shaped housing 10 which may be plastic or metal material with recognizable top 11 and bottom 12 portions, enclosed side portions with said recognizable bottom portion 12 being open. For explanation purposes, each of the four sides of the present invention has been given a letter from A–D to reduce confusion. Both end members A and C of the head rail attachment 10 are fitted with end caps 14 and 15. A round bar 16, inside said hollow, rectangular-shaped housing 10, extends lengthwise from side A to side C or vice versa, and protrudes slightly through each end cap 14 and 15. A vertical carrier 17 is attached on Side A to the outside of end cap 14 and secured to the protruding round bar 16 by mechanical means, such as a lock washer 18; this configuration becomes the front of the present invention.

Another end cap 15, positioned on Side C, is also secured by mechanical means, such as a lock washer 18. A plastic spacer 19 approximately ½ inch wide, is attached to side B by mechanical means, such as metal screws 20 Affixed to the plastic spacer 19 is another vertical carrier 21 which may be held in position by a nut 25 and lock washer 22. The plastic spacer 19 is used to position the vertical carrier 21 properly so it will align with the vertical carrier 16 on side A, thus forming a 90 degree angle or framed look. The nut 25 and lock washer 22 are used to allow the vertical carrier 21 to be adjusted to the proper position before tightening the lock washer 22. Upon completion of the above assembly, two vertical slats 23 may be positioned within the vertical carriers 17 and 21 which form a 90 degree angle to prevent sunlight from passing through.

The head rail attachment 10 may be mechanically secured perpendicular to an existing vertical blind head rail 24 by means of a flat piece of metal 25 which bridges the head rail 24 and the head rail attachment 10 or by other securing means.

The foregoing description of the invention has been directed to a particular preferred embodiment of the present invention for purposes of explanation and illustration. It will be apparent to those skilled in the art that many modifications and changes in the head rail attachment may be made without departing from the scope an spirit of the invention. It is therefore intended that the following claims cover such modifications and changes:

What I claim is:

1. An attachment for a head rail assembly comprising a hollow, rectangular-shaped housing, having recognizable top and bottom portions, having a circular shaped bar extending lengthwise through said housing, end caps attached to at least two ends of said housing, at least two vertical carriers adjustably attached and secured to said housing, with means of attaching said vertical carriers to said housing and means of attaching said housing to said head rail assembly.

2. An attachment for a head rail assembly of claim one wherein said recognizable bottom portion of said housing is not enclosed, whereby allowing easy access to inside of said housing.

3. An attachment for a head rail assembly of claim one wherein said circular shaped bar protrudes slightly through said end caps of said housing.

4. An attachment for a head rail assembly of claim one wherein said vertical carriers are adjustably attached by means of metal screws.

5. An attachment for a head rail assembly of claim one wherein said vertical carriers ar attached by means of a nut and lock washer assembly whereby allowing adjusting of said vertical carrier to proper position before tightening said lock washer into place.

6. An attachment for a head rail assembly of claim one wherein said means of attaching said housing to said head rail assembly is a metal bridge mechanically attached to said head rail assembly and said housing.

7. An attachment for a head rail assembly of claim one wherein said means of attaching said housing to said head rail assembly is a T-shaped piece of metal which mechanically affixes and secures said head rail assembly to said housing.

* * * * *